United States Patent [19]

Hamilton et al.

[11] 4,222,797

[45] Sep. 16, 1980

[54] METHOD OF IMPARTING A FINE GRAIN STRUCTURE TO ALUMINUM ALLOYS HAVING PRECIPITATING CONSTITUENTS

[75] Inventors: C. Howard Hamilton, Thousand Oaks; Murray W. Mahoney, Camarillo; Neil E. Paton, Thousand Oaks, all of Calif.

[73] Assignee: Rockwell International Corporation, El Segundo, Calif.

[21] Appl. No.: 62,203

[22] Filed: Jul. 30, 1979

[51] Int. Cl.[2] ..... C22F 1/04

[52] U.S. Cl. ..... 148/12.7 A

[58] Field of Search ..... 148/12.7 A

[56] References Cited

U.S. PATENT DOCUMENTS 4,092,181 5/1978 Paton et al. ..... 148/12.7 A

*Primary Examiner*—R. Dean

*Attorney, Agent, or Firm*—L. Lee Humphries; Craig O. Malin

[57] ABSTRACT

A method is provided for imparting a fine grain structure to aluminum alloys which have precipitating constituents. The alloy is first heated to a solid solution temperature to dissolve the precipitating constituents in the alloy. The alloy is then cooled, preferably by water quenching, to below the solution temperature and then overaged to form precipitates by heating it above the precipitation hardening temperature for the alloy but below its solution treating temperature. Strain energy is introduced into the alloy by plastically deforming it in a temperature range of 380° F. to 450° F. to reduce its cross-sectional area a total of 40% minimum, at least 25% of the reduction in area being accomplished in a single continuous deformation operation. The alloy is then subsequently held at a recrystallization temperature so that new grains are nucleated by the overaged precipitates and the development of these grains results in a fine grain structure.

2 Claims, No Drawings

METHOD OF IMPARTING A FINE GRAIN STRUCTURE TO ALUMINUM ALLOYS HAVING PRECIPITATING CONSTITUENTS

STATEMENT OF GOVERNMENT INTEREST

The invention herein described was made in the course of or under a contract or subcontract thereunder, with the Department of the Air Force.

BACKGROUND OF THE INVENTION

1. Field of the Invention

This invention relates to the field of metallurgy, and particularly to the field of processing precipitation hardenable aluminum alloys.

2. Description of the Prior Art

A fine grain size tends to improve the mechanical properties of most structural materials. Additionally, formability can be improved by elimination of "orange peel" structure, and superplasticity realized in many alloys by providing a fine grain structure. For alloys which are susceptable to stress corrosion cracking such as many precipitation hardening aluminum alloys, a fine grain structure generally decreases the susceptibility to stress corrosion. However, grain refinement is difficult to achieve in aluminum alloys, and most attempts to obtain a fine grain size by conventional mechanical working and recrystallization by heating have only resulted in the material recrystallizing to the original coarse grain size with large "pancake" shaped grains.

A method for obtaining grain refinement for 7075 aluminum alloy is described in U.S. Pat. No. 3,847,681 to Waldman, Sulinski, and Marcus and reported in a paper by the same inventors entitled "The Effect of Ingot Processing Treatment on the Grain Size and Properties of Al Alloy 7075," Metallurgical Transactions, vol. 5, March 1974, pp. 573–584. The Waldman treatment requires a long-time high-temperature homogenization to precipitate chromium followed by slow cooling to precipitate Zn, Mg, and Cu. The 7075 aluminum alloy is then mechanically worked and recrystallized by heating to refine the grain size. This prior art method is limited to alloys containing specific elements such as chromium and does not create as fine a grain size as does the method of the present invention.

U.S. Pat. No. 4,092,181 to Paton and Hamilton (two of the three present inventors) describes a method of imparting a fine grain to precipitation hardening aluminum alloys. The present invention is an improvement of the earlier patented method in that it describes additional conditions for minimizing the grain size.

SUMMARY OF THE INVENTION

It is an object of the invention to provide an improved method for refining the grain size of aluminum alloys containing precipitation hardening constituents.

It is an object of the invention to provide an improved method for imparting fine grains uniformly distributed across the material thickness in aluminum alloys having precipitating constituents.

It is an object of the invention to improve properties such as strength and fatigue resistance of precipitation hardening aluminum alloys by providing an improved method to refine the grain size.

It is an object of the invention to improve the resistance of precipitation hardening aluminum alloys to stress corrosion cracking by providing an improved method to refine the grain size.

It is an object of the invention to improve the formability of precipitation hardening aluminum alloys by providing an improved method of refining the grain size.

It is an object of the invention to improve the forgeability of precipitation hardening aluminum alloys by providing an improved method of refining the grain size.

It is an object of the invention to improve the superplastic properties of precipitation hardening aluminum alloys by providing an improved method of refining the grain size.

According to the invention, a method is provided for imparting a fine grain structure to aluminum alloys which have precipitating constituents. The alloy is first heated to a solid solution temperature to dissolve the precipitating constituents in the alloy. The alloy is then cooled, preferably by water quenching, to below the solution temperature and then overaged to form a uniform distribution of small precipitates by heating it above the precipitation hardening temperature for the alloy but below its solution treating temperature. Strain energy is introduced into the alloy by plastically deforming it in a temperature range of 380° F. to 450° F. to reduce its cross-sectional area a total of 40% minimum, at least 25% of the reduction in area being accomplished in a single continuous operation. The alloy is then subsequently held at a recrystallization temperature so that new grains are nucleated by the overaged precipitates and the growth of these grains provides a fine grain structure.

These and other objects and features of the present invention will be apparent from the following detailed description, taken with reference to the accompanying drawings.

DESCRIPTION OF THE PREFERRED EMBODIMENT

According to the invention, the alloy is first solution treated in the conventional way, as would be done prior to precipitation hardening. This places the material in a coarse-grained condition. Instead of being followed by the standard precipitation hardening treatment (a low temperature aging treatment to produce a fine distribution of precipitates spaced 100 to 500 Å apart suitable for increasing the strength of the alloy), the material is subjected to a high temperature precipitation treatment, called overaging, which produces a somewhat coarser distribution of precipitates spaced ~5,000 to 10,000 Å apart, as described in U.S. Pat. No. 4,092,181.

Next, the material is mechanically worked (plastically deformed) to provide lattice strain necessary for recrystallization. As known in the industry, plastic deformation can be accomplished by rolling, by extrusion, by drawing, and by forging to produce various products such as plate, bar, sheet, wire, forgings, etc.

To obtain the minimum grain size, the cross-sectional area must be reduced at least 40%, and at least 25% of this reduction in area must be done in a single continuous deformation operation. Additionally, the deformation must be done at as low a temperature as possible without rupturing the material in order to maximize the lattice strain.

Finally, the worked material is heated above the recrystallization temperature to induce recrystallization at which time new grains are nucleated on the precipitates formed during the previous overaging treatment. It also appears that these precipitates act to retard further grain growth.

The following examples are illustrative of the invention as applied to 7075 aluminum alloy. Alloy 7075 is a precipitation hardening aluminum base alloy containing (nominally) 5.5% Zn, 2.5% Mg, 1.5% Cu, and 0.3% Cr. It is solution treated at 860° F. to 930° F. for three hours and then water quenched to maintain the precipitate in solution. The normal precipitation hardening treatment for 7075 alloy is 240° F. to 260° F. for 23 to 28 hours and produces a fine precipitate spaced only 100 to 500 Å apart. While this conventional precipitation hardening treatment produces good strength in the alloy, it does not produce a fine grain size. Therefore, rather than using the standard precipitation hardening treatment, the solution treated alloy is overaged 700° F. to 800° F. (preferable at 750° F.) for about 8 hours. This produces a somewhat coarse distribution of precipitates spaced approximately 5,000 to 10,000 Å apart.

The overaged alloy is plastically deformed by reducing its cross-sectional area a total of 40% minimum at a temperature of 380° F. to 450° F., at least 25% of the reduction in area being accomplished during at least one continuous process in order to strain the lattice sufficiently to permit recrystallization of the structure. The alloy is then heated at 600° F. to 930° F. to cause recrystallization into a fine-grain structure.

EXAMPLE I

A one-inch thick plate of 7075 alloy was solution treated and overaged to produce precipitates as described above. Samples of this plate were heated to 400°±20° F. and progressively rolled to thinner cross-sections by passing the hot plate several times between a pair of rolls. the distance between the rolls was decreased for each succeeding pass so that the thickness of the plate was reduced in several passes to one-quarter inch. Thus, the total reduction in thickness was 75%.

Each separate pass of the plate between the rolls is a single continuous deformation process. If the distance between the rolls is decreased only slightly for each pass (a light pass), then many passes are required to obtain the final thickness. If the distance is decreased greatly (a heavy pass), then only a few passes are required. According to the prior art, the number of passes is optimized to provide the most economical operation of the rolls, taking into consideration the capacity of the rolls and the ability of the alloy to be deformed at the rolling temperature without rupturing.

Because there is very little increase in the width of the plate during the rolling process, the reduction in cross-sectional area is directly proportional to the reduction in thickness. The technique of rolling plate is well known in the art and there are analogous processes for producing sheet, bar, extrusions, forgings, and other hot worked configurations for which the invention is applicable.

Table I shows three different roll schedules used to reduce the one-inch thick plate to one-quarter inch. The three samples were each reduced in thickness by a total of 75%, however, this reduction was accomplished by eleven light passes for sample 15 and by only three heavy passes for sample 11a.

The hot worked samples were then heated at 900° F. for one-half hour in accordance with the method described in U.S. Pat. No. 4,092,181 in order to recrystallize them. Microsections were prepared of all samples and the grain size measured parallel to the rolling direction. As shown in Table I, the grain size is small for all samples when compared to the grain size of typical prior art aluminum (approximately 100 μm.). Additionally, the grain size is related to the number of passes used to obtain the total 75% reduction; the samples receiving heavy passes having a finer grain than the samples receiving light passes.

In addition to having smaller grains, the samples subjected to heavy passes exhibited a fairly uniform grain size across the thickness of the 7075 aluminum. In contrast, the samples subjected to light passes had coarser grains near the center and fine grains near the surface.

TABLE I

| Sample | Pass No. | % Reduction in Thickness at Each Pass | % Total Reduction | Grain Size, μm |
|---|---|---|---|---|
| 11a | 1 | 21 | | |
| | 2 | 32 | | |
| | 3 | 52 | 75 | 12 |
| 1C | 1 | 4 | | |
| | 2 | 11 | | |
| | 3 | 14 | | |
| | 4 | 14 | | |
| | 5 | 22 | | |
| | 6 | 25 | | |
| | 7 | 32 | 75 | 14 |
| 15 | 1 | 6 | | |
| | 2 | 7 | | |
| | 3 | 7 | | |
| | 4 | 8 | | |
| | 5 | 10 | | |
| | 6 | 10 | | |
| | 7 | 12 | | |
| | 8 | 13 | | |
| | 9 | 13 | | |
| | 10 | 16 | | |
| | 11 | 15 | 71 | 23 |

EXAMPLE II

Test samples of one-inch thick plate of 7075 alloy were treated in a manner similar to that previously described for Example I except that different roll schedules were used to obtain a total reduction in thickness of 85%. Table II shows the roll schedules used and the resultant grain size. The sample which received the heavier passes (sample 13a) had finer grains than the other sample (sample 18).

TABLE II

| Sample | Pass No. | % Reduction in Thickness at Each Pass | % Total Reduction | Grain Size, μm |
|---|---|---|---|---|
| 13a | 1 | 40 | | |
| | 2 | 50 | | |
| | 3 | 50 | 85 | 12 |
| 18 | 1 | 36 | | |
| | 2 | 25 | | |
| | 3 | 23 | | |
| | 4 | 26 | | |
| | 5 | 44 | 85 | 16 |

EXAMPLE III

Samples of 7475 and 2219 aluminum alloy were processed in accordance with the method described in U.S. Pat. No. 4,092,181 except that different rates of plastic deformation were applied in order to determine the effect of rate on the recrystallized grain size. These alloys behaved similarly to the 7075 alloy tested in Examples I and II in that high rates of deformation (heavy roll passes) resulted in finer grains.

EXAMPLE IV

Samples of 7075 aluminum alloy plate were rolled at various temperatures to determine the effect of rolling temperatures on grain size. The results of these tests (Table III) show that the lower the rolling temperature, the finer the recrystallized grain. The temperature must, of course, be sufficiently high to prevent rupture of the alloy during deformation.

TABLE III

| Rolling Temperature, F. | Grain Size, μm |
|---|---|
| Room Temperature | Shattered |
| 300 | split |
| 400 | 17 |
| 500 | 24 |
| 600 | 34 |

From the above examples, one skilled in the art can readily develop appropriate heat treatment and plastic deformation schedules for any precipitation hardening aluminum alloy based upon standard solution treating and precipitation hardening treatments. Additionally, numerous variations and modifications may be made without departing from the present invention. Accordingly, it should be clearly understood that the form of the present invention described above and shown in the accompanying drawings is illustrative only and is not intended to limit the scope of the present invention.

What is claimed is:

1. An improvement in a method of imparting a fine grain structure to an aluminum alloy having a precipitating constituent, said method having steps of:

providing an aluminum alloy having a precipitating constituent;

dissolving at least some of said precipitating constituent in said alloy by heating said alloy to a solid solution temperature;

cooling said alloy to a temperature below said solid solution temperature;

overaging said alloy to form precipitates;

plastically straining said alloy; and recrystallizing said alloy by heating it above the minimum recrystallization temperature, whereby said precipitates form nuclei for the recrystallization and controlled growth of a fine grain structure;

said improvement being characterized in that said step of plastically straining said alloy comprises:

heating said alloy to a temperature in the range of 380° F. to 450° F. and reducing its cross-sectional area a total of 40% minimum, at least 25% of the reduction in area being accomplished in a single continuous deformation operation.

2. A method of imparting a fine grain structure to 7075 aluminum alloy comprising:

providing 7075 aluminum alloy;

heating said alloy to a solution temperature in the range of 820° F. to 930° F. to dissolve precipitating constituents in said alloy;

cooling said alloy to a temperature below said solution temperature;

heating said alloy to an overaging temperature in the range of 700° F. to 800° F. to overage said alloy;

plastically deforming said alloy by reducing its cross-sectional area a total of 40% minimum at a temperature of 380° F. to 450° F., at least 25% of the reduction in area being accomplished in a single continuous deformation operation; and heating said alloy to a temperature in the range of 600° F. to 930° F., whereby said alloy recrystallizes into a fine grain structure.

* * * * *